United States Patent [19]

Raab

[11] Patent Number: 4,913,413

[45] Date of Patent: Apr. 3, 1990

[54] UNIVERSAL LEG HOLDER

[75] Inventor: Simon Raab, Lorraine, Canada

[73] Assignee: Faro Medical Technologies Inc., Montreal, Canada

[21] Appl. No.: 364,199

[22] Filed: Jun. 9, 1989

[51] Int. Cl.[4] ..... A61G 13/00

[52] U.S. Cl. ..... 269/328

[58] Field of Search ..... 269/328, 45, 75–78, 269/131; 403/61, 187, 122; 128/133, 134; 378/208

[56] References Cited

U.S. PATENT DOCUMENTS

| | | | |
|---|---|---|---|
| 2,057,992 | 10/1936 | Wiruth | 269/328 |
| 2,067,891 | 1/1937 | Comper | 269/328 |
| 4,252,306 | 2/1981 | Johnson et al. | 269/328 |
| 4,373,709 | 2/1983 | Whitt . | |
| 4,407,277 | 10/1983 | Ellison . | |
| 4,426,071 | 1/1984 | Klerstad | 269/328 |
| 4,428,571 | 1/1984 | Sugarman . | |
| 4,526,355 | 7/1985 | Moore et al. . | |
| 4,545,573 | 10/1985 | Murphy | 269/328 |
| 4,615,516 | 10/1986 | Stullberg et al. . | |
| 4,717,133 | 1/1988 | Walsh et al. . | |

*Primary Examiner*—Robert C. Watson

*Attorney, Agent, or Firm*—Fishman, Dionne & Cantor

[57] ABSTRACT

A patient whose leg is to be operated on is disposed on an operating table under a surgical drape. The leg to be operated on is supported by the universal leg holder which includes facilities to expose as few parts thereof as possible to the sterile field whereby only a minimum number of parts will have to be auto-claved. The parts which have to be auto-claved can either be broken down or telescoped so that only small sized parts will have to be auto-claved.

18 Claims, 7 Drawing Sheets

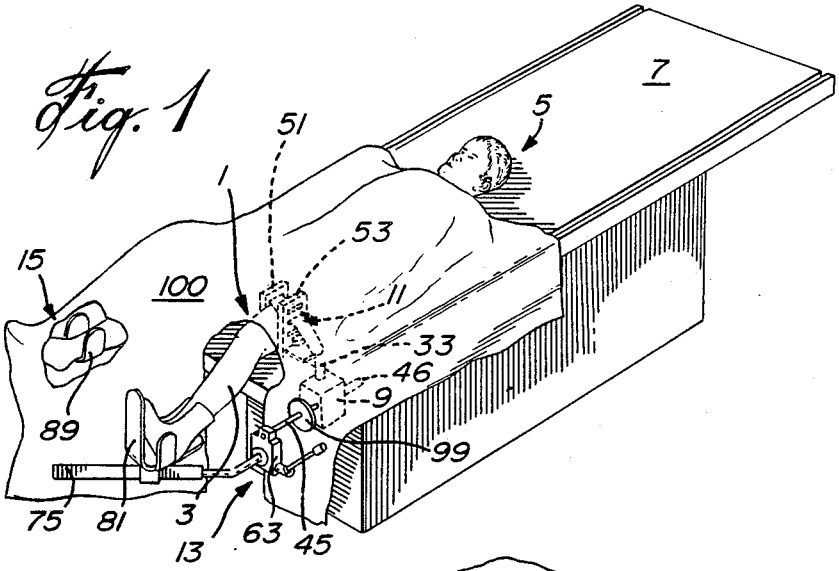
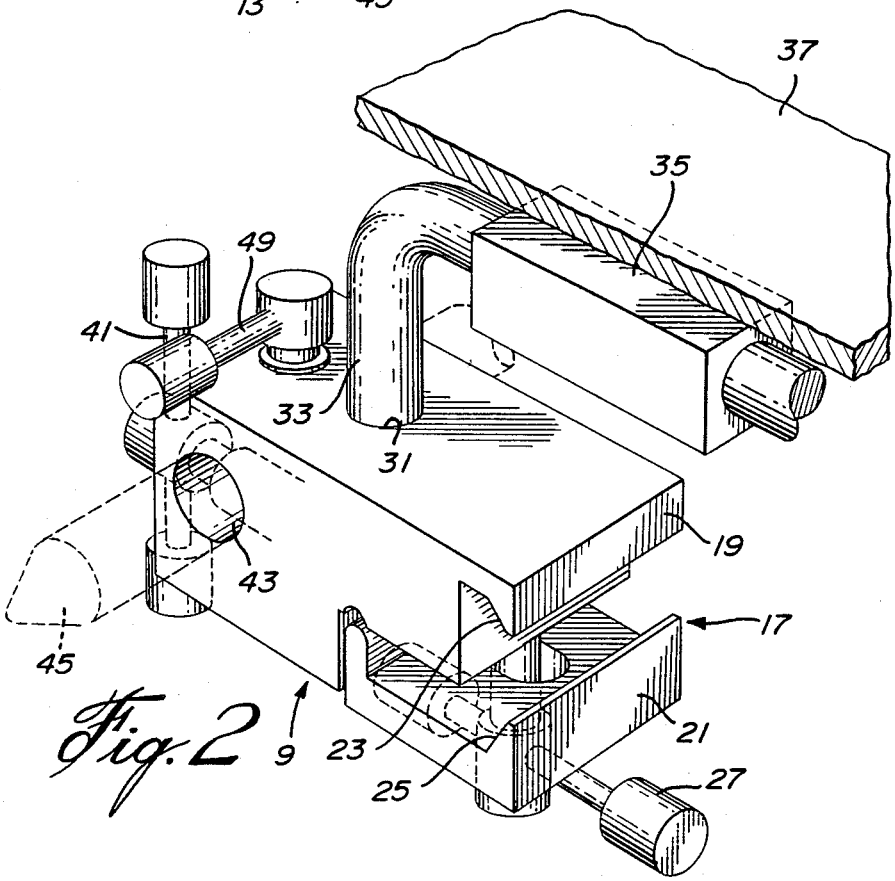
Fig. 2

101
107
135
147
133
113
131
116
117
146
144
143
145
115
118
120
137
119
139
141
121

UNIVERSAL LEG HOLDER

BACKGROUND OF INVENTION

1. Field of the Invention

The invention relates to a universal leg holder for supporting a leg of a patient lying on an operating table under a surgical draping during surgical procedures on the supported leg. More specifically, the invention relates to such a holder which can be broken down or telescoped into auto-clavable parts. In addition, the leg holder of the invention includes facilities for mounting the surgical draping such that a minimum number of parts of the leg holder are exposed to the sterile field.

2. Description of Prior Art

Various devices are taught in the prior art for supporting the leg of a patient during surgical procedures. Illustrative of such devices are the devices taught in U.S. Pat. No. 4,373,709, Whitt, Feb. 15, 1983, U.S. Pat. No. 4,407,277, Ellison, Oct. 4, 1983, U.S. Pat. No. 4,428,571, Sugerman, Jan. 31, 1984, U.S. Pat. No. 4,526,355, Moore et al, July 2, 1985, U.S. Pat. No. 4,615,516, Stullberg et al, Oct. 7, 1986, and U.S. Pat. No. 4,717,133, Walsh et al, Jan. 5, 1988.

U.S. Pat. No. 4,373,709 teaches a holder for supporting the upper limb only of the patient.

U.S. Pat. No. 4,407,277 is directed at an arthroscope and means for connecting the arthroscope. It also teaches a means for supporting the leg of a patient. However, with the leg holder in the '277 patent, the upper and lower limbs of the patient are not separately manipulable.

U.S. Pat. No. 4,526,355 also relates to a leg holder used during surgical procedures. It consists of a platform 26 which is supported by a rod 18. The rod is pivotable about a horizontal axis whereby the platform 26 is also pivotable about that same axis. Further, the rod 18 can be rotated in the clamp 22 so that it is also rotatable about a vertical axis so that the platform 26 is also rotatable about that same vertical axis. Platform 28 is pivotally connected to platform 26 by swivel lock 32, and platform 28 carries a leg holder arrangement 30 which consists of padded L-shaped members 36 and 40 between which the leg is inserted. The padded member 40 is slidable along the platform 28 on slidable carriage 56, and it is movable up and down relative to the platform 28 along post 44. Accordingly, the position and orientation of the leg holder can be adjusted in three planes. Once again, the holder of the '355 patent is to support only the upper or lower limb of the patient, usually the upper limb.

U.S. Pat. No. 4,615,516 teaches a device for supporting only the lower limb of a patient.

U.S. Pat. No. 4,717,133 teaches a means for supporting the upper limb only of a patient.

U.S. Pat. No. 4,428,571 teaches a limb holder and positioning device which includes a central support member 10, rod 11 extending outwardly from one end of the central support member 10, and an extension member 15 extending outwardly from the other end of the central support member 10. An L-shaped upper limb engaging member 14 is disposed on the central support member, and a lower limb engaging member 16 is disposed at the far end of the extension member 15. In the device in accordance with the '571 patent, the upper limb must remain stationary and cannot be manipulated. The lower limb can be manipulated relative to the upper limb. Further, with the '571 device, the knee of the patient must be suspended beyond the edge of the operating table. In addition, as the entire device of the '571 patent is in the sterile field, it must all be autoclaved.

SUMMARY OF INVENTION

It is therefore an object of the invention to provide a universal leg holder which overcomes the advantages of the prior art.

It is a more specific object of the invention to provide such a leg holder which is auto-clavable.

It is an even more specific object of the invention to provide such a leg holder which includes facilities for mounting the surgical draping such that a minimum number of parts are exposed to the sterile field.

It is an even more specific object of the invention to provide such a universal leg holder wherein the upper and lower legs are separately manipulable.

In accordance with the invention, there is provided a free arm universal leg holder for supporting a leg of a patient lying on an operating table under a surgical draping during surgical procedures on the supported leg. The leg holder includes a first support member for supporting the upper leg of the patient. Clamping means clampingly mount the first support member on the operating table such that the vertical distance between the first support member and the operating table is adjustable, the first support member being disposed under the surgical draping. A second support member supports the lower leg of the patient, and a second clamping means is provided for clampingly mounting the second support member on the operating table, the second clamping means also being disposed under the surgical draping. The second support member includes a transdraping spear which extends through the surgical draping into the second clamping means. Thus, a first part of the transdraping spear is under the surgical draping and a second part of the transdraping spear is in a sterile field outside of the surgical draping. The remainder of the second support member is connected to the free end of the second part of the transdraping spear and is disposed in the sterile field. Accordingly, only the transdraping spear and the remainder of the second support member need to be sterilized before surgical use.

Further, in accordance with the invention, there is provided a free arm universal leg holder for supporting the leg of a patient lying on an operating table under a surgical draping during surgical includes a clamp means mounted on an edge of the operating table. The clamp means supports a pivoting means pivotable about a horizontal axis, and a casing attachment is removably mounted on the pivoting means for pivoting therewith. Telescoping arm means extends from the casing attachment for supporting the supported leg, whereby the telescoping arm means is pivotable about the horizontal axis. The surgical draping is disposed between the pivoting means and the casing attachment, whereby the pivoting means is under the surgical draping and out of the sterile field, and only the casing attachment and telescoping arm means are in the sterile field.

BRIEF DESCRIPTION OF DRAWINGS

The invention will be better understood by an examination of the following description, together with the accompanying drawings, in which:

FIG. 1 is a perspective view of a patient on an operating table having the leg on which surgery is to be performed held by the free arm universal leg holder in accordance with the invention;

FIG. 2 is a perspective view of a table mount clamp;

DESCRIPTION OF PREFERRED EMBODIMENTS

Figure 3:
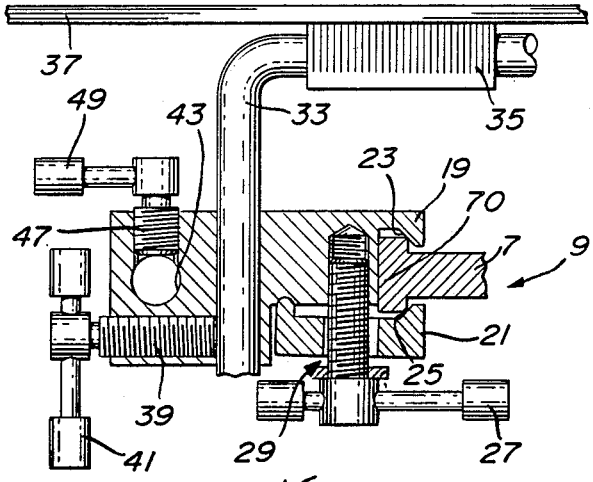
FIG. 3 is a cross-section through III—III of FIG. 2.

Referring to FIG. 1, there is illustrated a free arm universal leg holder, illustrated generally at 1, for supporting the leg 3, on which surgery is to be performed, of a patient 5 lying on an operating table 7. The holder includes a table mount clamp 9, an upper leg support member 11 and a lower leg support member 13. Also included is a leg support member 15 for supporting the leg on which surgery is not to be performed.

Turning now to FIGS. 2 and 3, the table clamp, indicated generally at 9, has a clamp block 17 at one end thereof. The clamp block 17 includes a stationary member 19 and a movable member 21. The stationary and movable members 19 and 21 comprise beveled faces 23 and 25 respectively to clamp on to an edge 70 of table 7 as shown in FIG. 3.

A handle 27 drives a screw and thread arrangement 29 schematically shown in FIG. 3, or other similar arrangement, to move the movable member 21 towards the stationary member 19 to thereby clamp the table mount clamp onto the edge of the table 7.

The table mount clamp has a top opening 31 for receiving a post 33 of upper leg support member 11. Mounted on a horizontal portion of the post 33 is a block 35. The block 35 is mounted on the post 33 to be pivotable thereabout. Block 35 mounts a platform 37 on the top surface thereof. Accordingly, the platform 37 is also pivotable about the horizontal portion of the post 33, i.e., about a horizontal axis. Both block 35 and platform 37 are removable from post 33.

The post 33 is movable into and out of the opening 31 whereby to adjust the vertical distance between the platform 37 and the operating table 7. The post 33 is clamped into a position by screw and thread arrangement, shown schematically at 39, or other similar arrangement, driven by handle 41 as seen in FIG. 3.

The table mount clamp 9 also includes a side opening 43 which receives post 45, referred to, for reasons explained below, as a transdraping spear, of lower leg support member 13. For reasons which will also be discussed below, post 45 is movable into and out of opening 43 and is clamped into a position by a screw and thread arrangement shown schematically at 47, or similar means, driven by handle 49 as shown in FIG. 3.

It can also be seen in FIGS. 2 and 3 that post 33 is rotatable about a vertical axis in opening 31 so that platform 37 is also rotatable about the same vertical axis. In the same way, post 45 is rotatable about a horizontal axis in opening 43.

Figure 4:
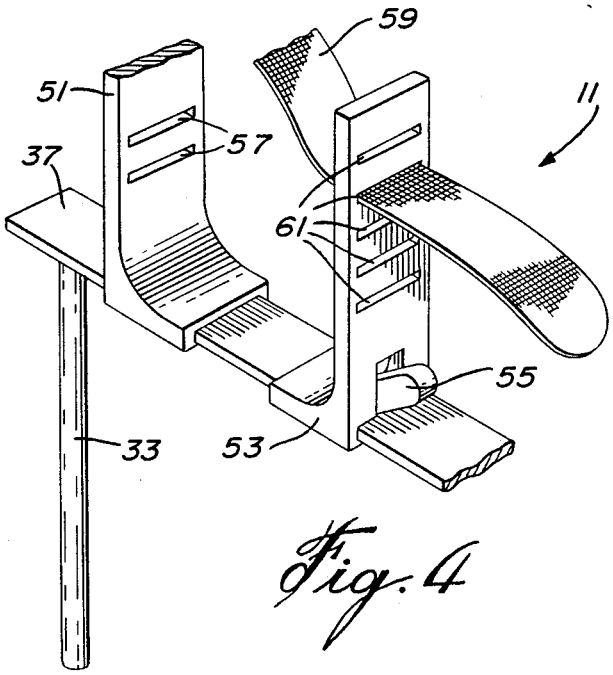
FIG. 4 is a perspective view of the upper leg support member.

Referring now to FIG. 4, platform 37 mounts movable side walls 51 and 53 of a thigh restraining arrangement. The movable side walls 51 and 53 can be fixed into position by clamps (55 on side wall 53 clamp for side wall 51 not shown).

Side wall 51 has a plurality of spaced horizontal slots 57, and side wall 53 has a plurality of horizontal slots 61. The slots 57 receive one end of a strap 59, preferably of a Velcro material, and the slots 61 receive the other end of the strap 59.

Figure 5:
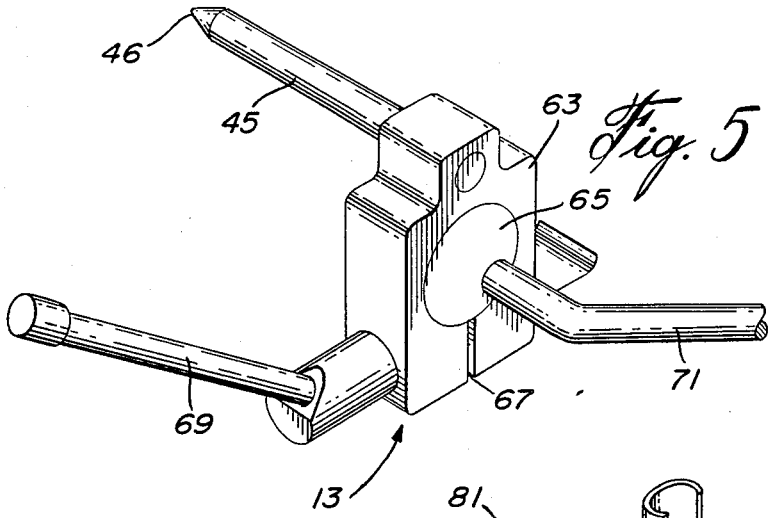
FIG. 5 is a perspective view of a portion of the lower leg support member.

Turning now to FIG. 5, the lower leg support member 13 includes a block 63 having an opening for housing a ball 65. The ball 65 in block 63 forms a ball joint. A spaced opening 67 is included at the bottom of the block 63, and the opening 67 can be closed by the manipulation of handle 69 which drives a screw and thread arrangement (not shown) whereby the ball 65 will be clamped into position.

Figure 6:
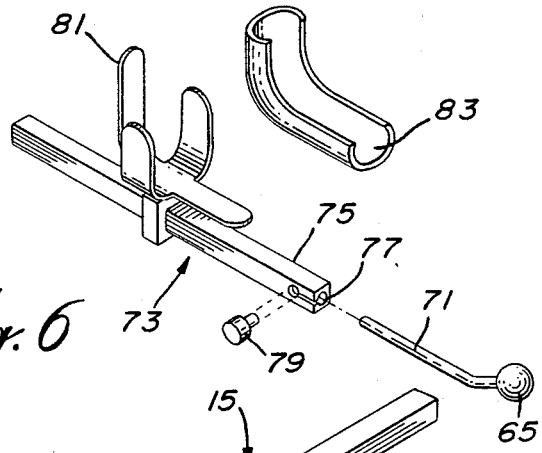
FIG. 6 is a perspective view of the remainder of the lower leg support member.

Extending from the ball 65 is a post 71. As seen in FIG. 6, the post 71 is attachable to a foot support member illustrated generally at 73. The foot support member 73 includes a square post 75 having a cavity 77 at one end thereof. Post 71 extends into the cavity 77 and is clamped into position in the cavity by stud 79.

Square post 75 supports a foot rest 81, and a foam insert 83 is insertable into the foot rest 81 to protect the foot of the patient. The foot rest 81 is removable from square post 75.

As described in relation with FIGS. 2 and 3, post 45 is movable into and out of opening 43 of table mount clamp 9 so that the horizontal distance between block 63, and therefore lower leg support member 13, and the operating table 7 is adjustable.

Figure 7:
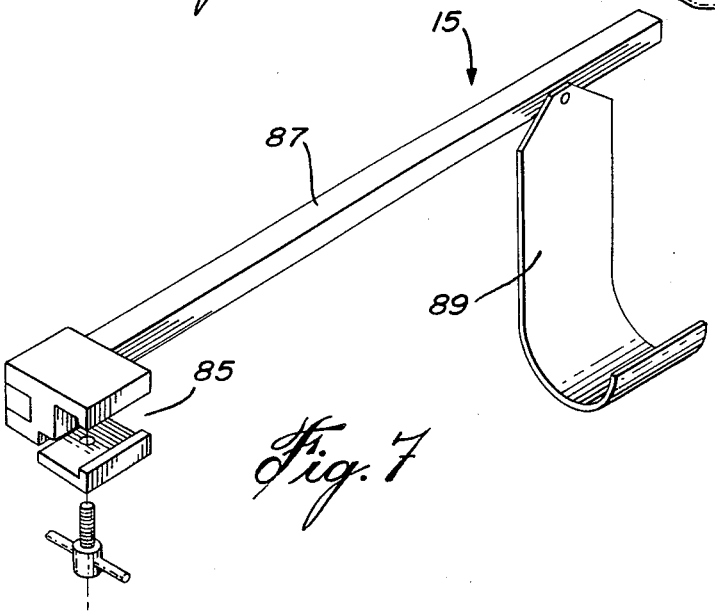
FIG. 7 is a perspective view of the leg support member for the leg on which surgery is not being performed.

Referring now to FIG. 7, the support member 15 for the other leg includes a clamp block 85 by which 15 can be clamped to the side of the operating bed. Extending from the clamp block 85 is a square post 87 which supports a calf holder 89.

In operation, the thigh of the leg on which surgery is to be performed is placed on platform 37 between side walls 51 and 53. The platform can be rotated about a vertical axis and tilted about a horizontal axis as above described, and the height of the platform 37 above the operating table can be adjusted, as also above described, for the comfort of the patient and the ease of the surgeon. For the thigh to be placed between the side walls, one of them, say side wall 51 is fixed by its clamp and the other side wall (53), is moved away from the side wall 51 to allow ample space for insertion of the patient's thigh. When the thigh is resting on the platform 37 between the side walls, the side wall 53 is moved towards the stationary fixed wall 51 to a point where the side walls restrain the thigh of the patient. Side wall 53 is then clamped into position by clamp 55. Handle 41 is, of course, rotated to clamp post 33 into position.

Surgical drape 100 (see FIG. 1) is then draped over the patient so that only the lower leg, the knee and a short length of upper leg above the knee are exposed in the sterile field.

It is noted that the upper leg support is out of the sterile field so that it does not have to be sterilized in an auto-clave. In the same way, table mount clamp 9 is covered by surgical drape 100, so that it too does not need to be auto-claved.

To connect the lower leg support to table mount clamp 9, the pointed end 46 of the transdraping spear 45 (see FIGS. 1 and 5) pierces a hole through surgical drape 100 and is then moved, on the other side of the drape, into opening 43. Foam disc 99 (see FIG. 1), mounted on the transdraping spear 45, abuts the surgical drape 100, on the sterile side thereof, to prevent contamination of the sterile field through the hole pierced in surgical drape 100. Handle 49 is then rotated to clamp transdraping spear 45 in position.

Thus, the only parts of the holder which need to be auto-claved are transdraping spear 45, block 63 and the lower leg support.

Referring to FIG. 5, post 71, transdraping spear 45 and handle 69 are all removable from block 63. Referring to FIG. 6, post 71 is detachable from square post 75, and leg holder 81 is removable from square post 75. Accordingly, all elements which have to be sterilized are broken down into small enough parts to be autoclavable even in a small auto-clave.

The foot of the leg on which surgery is to be performed is then placed in foot holder 81. For this purpose, the horizontal spacing between the patient's foot and the operating table can be varied by sliding foot holder 81 along square post 75.

The attitude of the lower leg can then be adjusted to any desired position by manipulation of the square post 75, and thus the post 71, around the ball joint before ball 65 is clamped into position. When the correct attitude is attained, handle 69 is manipulated to clamp ball 65 into position in block 63.

It can be seen from the above description that the main purpose of the table mount 9 is to provide openings 31 and 43 for receiving posts 33 and 45 respectively. It would be obvious to one skilled in the art that such openings could be provided in appropriate edges and surfaces of the operating table. Thus, the opening 31 could be provided in the top surface adjacent the side edges at the front of the operating table, and the opening 43 could be provided in the front edge of the operating table. Such openings would, of course be provided on both the left and right sides of the operating table so that either a left or right leg could be supported for surgery on the operating table.

Of course, appropriate clamping arrangements would be provided for each of the openings so that the posts 33 and 45 could be clampingly restrained in the respective ones of the openings.

Accordingly, a further embodiment of the invention comprises the upper leg support member and the lower leg support member without the table mount clamp. In this embodiment, as above-noted, the table mount clamp would be replaced by appropriate openings in the top surface and front edge of the operating table.

Figure 8:
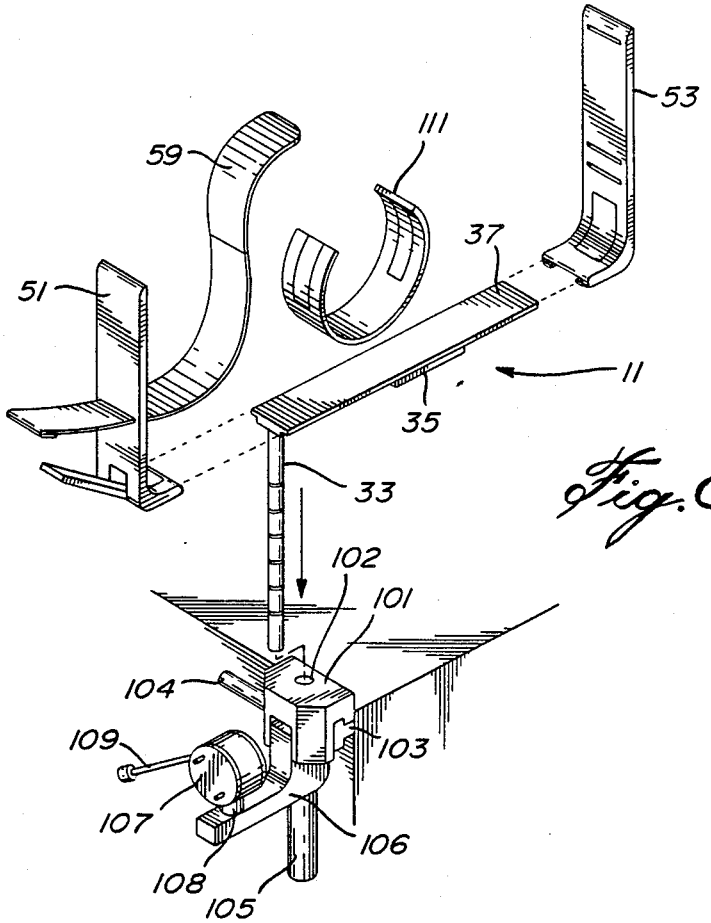
FIG. 8 illustrates a clamping means and pivoting means in accordance with a second embodiment of the invention.

A second embodiment of the invention is illustrated in FIGS. 8 to 13. Turning first to FIG. 8, the second embodiment includes a clamping block 101 having an opening 102 and a top surface thereof. The clamping block is mounted on T-shaped rail 103 which extends around the edges of an operating table. Clamping block 101 can be fixed in position by clamping handle 105.

The upper leg support member 11 includes the same parts as described above with respect to FIG. 4. It also includes a Velcro-attached foam pad 111. Post 33 of the upper leg support member is inserted in opening 102 and is clamped into position with clamping handle 104. Accordingly, the height of the upper leg support member above the operating table is adjustable.

Extending outwardly from one side of the clamping block 101 is a platform 106. Platform 106 supports a pivoting means 107 on a cylinder 108. The pivoting means 107 comprises a friction ratchet clutch adjustable by handle 109.

Figure 9:
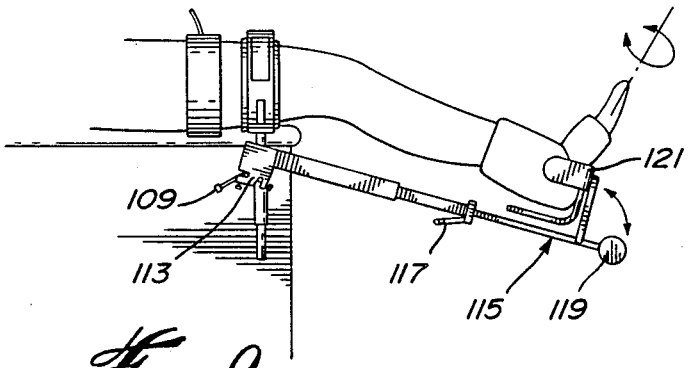
FIG. 9 illustrates the complete leg support in accordance with the second embodiment.

Turning now to FIG. 9, a casing attachment 113 is mounted over the pivoting means 107. A telescoping arm 115 extends from the casing attachment 113. The positions of the elements of the telescoping arm is adjustable by friction lock 117. Disposed at the free end of the telescoping arm is a concave shaped buttress 119 (see also FIGS. 11 and 12), and disposed adjacent the free end of the telescoping arm is a foot support 121.

Figure 10:
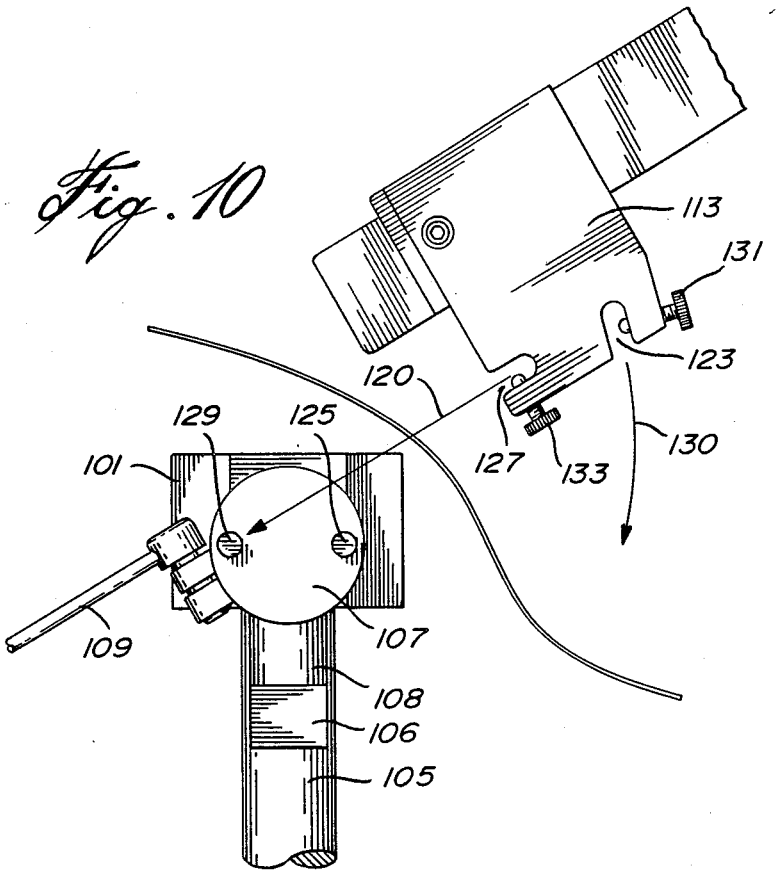
FIG. 10 illustrates in greater detail the pivoting means and the casing mounted on the pivoting means.

The ratchet clutch is housed in a cylindrical housing. Turning to FIG. 10, extending from one end of the cylindrical housing are pins 125 and 129. A second set of aligned pins (not shown in the drawings) extend from the other end of the cylindrical housing. Casing attachment 113 includes mating slots 123 and 127. To mount casing attachment 113 on the friction ratchet clutch 107, the housing is thrust forward in the direction of the arrow 120 so that pin 129 is disposed in slot 127. The casing attachment is then pivoted downwardly, in the direction of arrow 130, so that pin 125 is disposed in slot 123. As can be seen, surgical draping 135 is disposed between the casing attachment 113 and the friction ratchet clutch 107, so that friction ratchet clutch 107 and clamping means 101 are under the surgical draping and out of the sterile field. Screws 131 and 133, having rounded front ends to avoid penetration of the surgical draping, are used to tighten the casing attachment onto the friction ratchet clutch.

Figure 11:
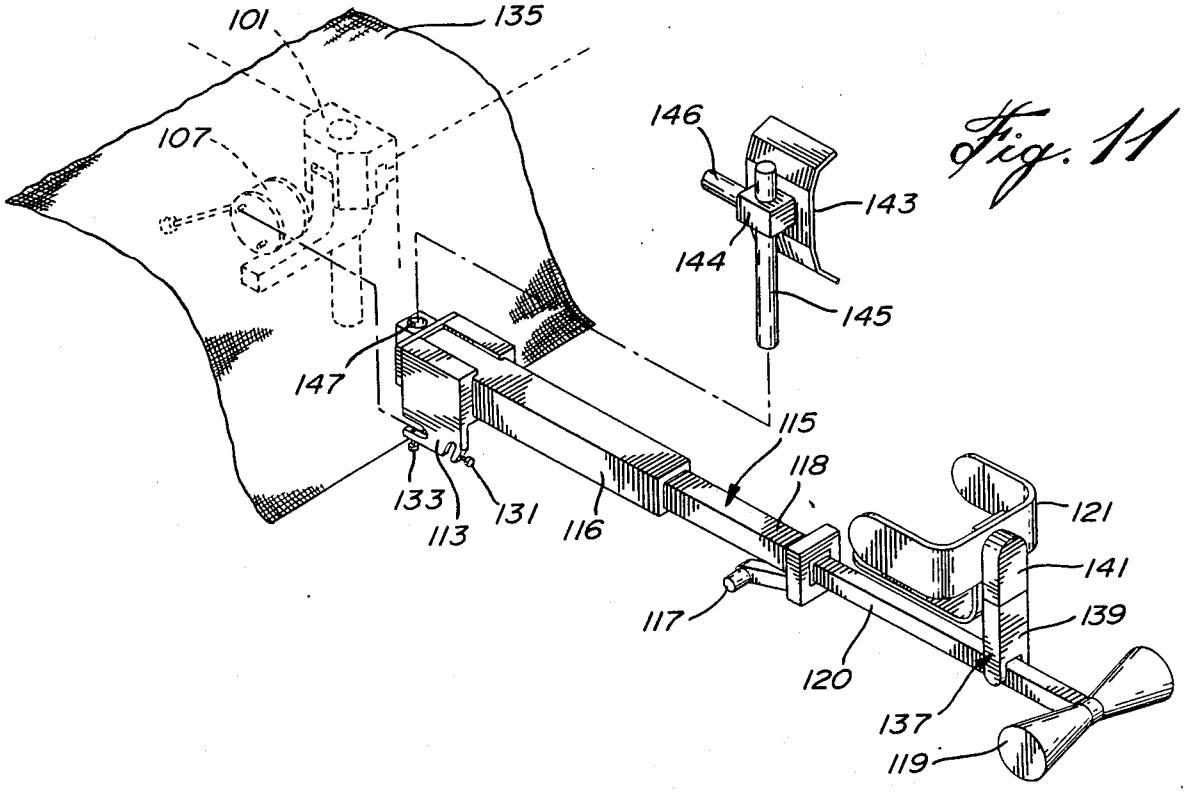
FIG. 11 illustrates how the surgical draping shields parts of the leg holder from the surgical field.

Turning now to FIG. 11, it can be seen that the telescoping arm 115 consists of elements 116, 118 and 120. Element 120 is telescopable into element 118 which is in turn telescopable into element 116. Thus, only a small length needs to be inserted into an auto-clave for sterilization.

It can also be seen that the foot support 121 is supported by a vertical member 137 consisting of parts 139 and 141. 141 is pivotable relative to 139 so that the foot support is pivotable about a vertical axis. The vertical support 137 also pivots backwardly and forwardly on element 120 (see also FIG. 12).

In FIG. 1, an upper leg support member was illustrated so that the leg holder can function for surgical procedures performed in what is known as the "off the end" surgical position. In order to permit the leg holder to function for surgical procedures performed in what is known as an "off the side" surgical position, stress plate 143 is utilized. As can be seen, the stress plate 143 includes a cylinder 145 movable in block 144. The cylinder 145 is held in position in block 144 by adjustment of a handle 146. The handle can against the cylinder and prevent it from moving as is well known in the art.

The cylinder 145 is inserted into opening 147 at the top surface of the free end of casing attachment 113. The height of the stress plate is adjusted by moving it, together with block 144, up and down on cylinder 145. As can be seen, the stress plate and its associated parts are in the sterile field so that the stress plate and its associated parts will have to be made of an auto-clavable material.

Figure 12:
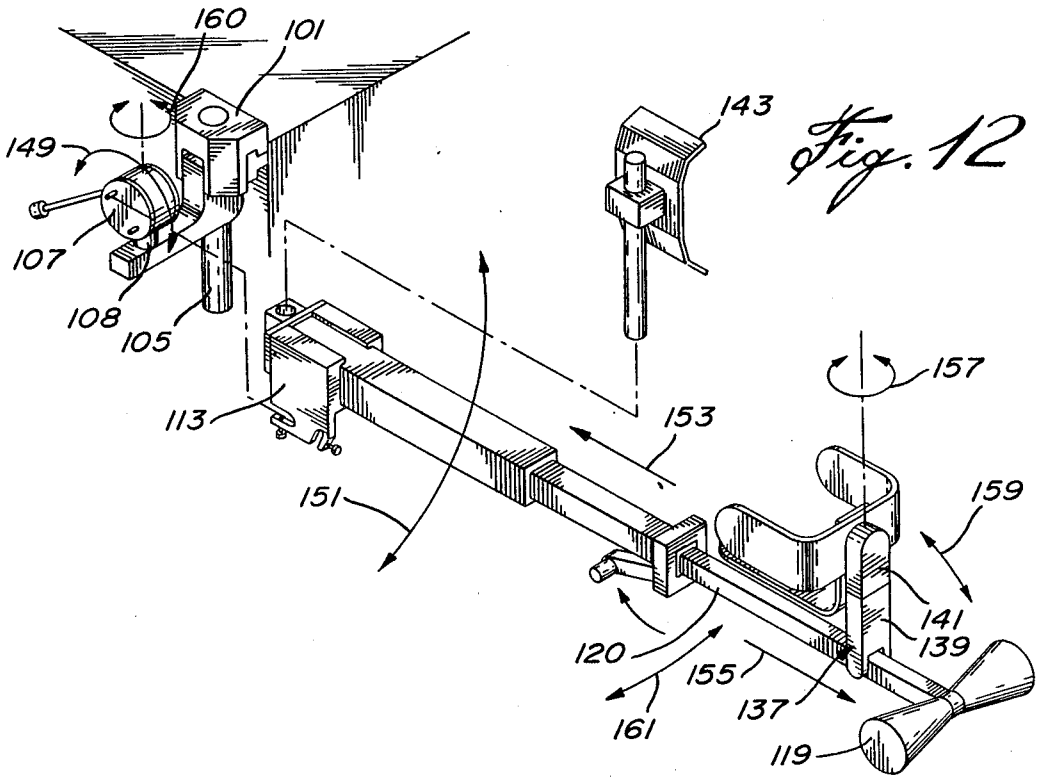
FIG. 12 illustrates the pivoting parts of the leg holder and in the directions in which they are pivotable.

Referring now to FIG. 12, as friction ratchet clutch 107 is pivotable in the direction of arrow 149, and as the casing attachment 113 is attached to friction ratchet clutch 107, and as telescoping arm 115 extends from the casing attachment 113, telescoping arm 115 is pivotable about a horizontal axis in the directions of arrow 151. In addition, the telescoping arm is adjustable in the directions of arrows 153 and 155 by the simple act of telescoping the arm inwardly or outwardly.

As the friction ratchet clutch 107 is also pivotable about a vertical axis, in the directions of arrow 160, the telescoping arm is also pivotable from side to side in the direction shown by arrow 161.

As part 141 of vertical support 137 is pivotable about a vertical axis relative to part 139 in the direction shown by arrow 157, the foot support is pivotable in the directions of arrow 157. As above-mentioned, vertical support 137 pivots backwardly and forwardly, as shown by arrow 159, on element 120.

To position the leg on which surgery is to be performed in the leg holder, the surgeon can hold the leg to be supported and manipulate the telescoping arm by movement of buttress 119 with either his hip, waist or leg.

It can be seen that, in both embodiments, facilities are provided for mounting the surgical draping such that a minimum number of parts of the leg holder are exposed to the sterile field. Thus, only a minimum number of parts need to be auto-claved. In the first embodiment, only block 63, transdraping spear 45, bolt 71 and square post 75 need to be auto-claved. In the second embodiment, only the casing attachment 113, telescoping arm 115, (with foot attachments) and, when using the "off the side" surgical position, stress plate 143 have to be auto-claved. All of the above elements will, of course, be made of an auto-clavable material.

Figure 13:
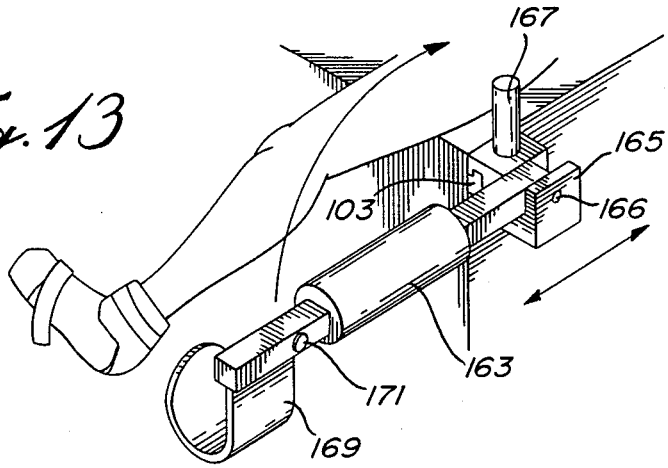
FIG. 13 illustrated a second embodiment of a leg support member for the leg on which surgery is not being performed.

Turning now to FIG. 13, a second embodiment for supporting the leg which is not being operated on, includes a clamp 165, which is once again mounted on T-shaped rail 103, and which is clamped into position by handle 167, and an elongated member 163 which is pivotably supported in 165 to pivot about pivot point 166. The elongated member 163 supports calf holder 169 which is mounted to pivot about pivot point 171.

Although particular embodiments have been described, this was for the purpose of illustrating, but not limiting, the invention. Various modifications, which will come readily to the mind of one skilled in the art, are within the scope of the invention as defined in the appended claims.

The embodiments of the invention in which an exclusive property or privilege is claimed are defined as follows:

1. A free arm universal leg holder for supporting a leg of a patient lying on an operating table under surgical draping during surgical procedures on the supported leg;

said leg holder comprising;

a first support member for supporting the upper leg of said patient;

first clamping means for clampingly mounting said first support member to said operating table such that the vertical distance between said first support member and said operating table is adjustable, said first support member being disposed under said surgical draping;

a second support member for supporting the lower leg of said patient;

second clamping means for clampingly mounting said second support member to said operating table, said second clamping means being disposed under said surgical draping;

said second support member comprising a transdraping spear, said transdraping spear extending through said surgical draping into said second clamping means;

whereby, a first part of said transdraping spear is under said surgical draping and a second part of said transdraping spear is in a sterile field outside said surgical draping;

the remainder of said second support member being connected to the free end of the second part of said transdraping spear and being disposed in said sterile field;

whereby said telescoping arm is pivotable about said horizontal axis;

whereby, only said transdraping spear and the remainder of said second support member need to be sterilized before surgical use.

2. A holder as defined in claim 1 wherein said second support member further comprises an elongated arm connected at one end thereof to a ball joint;

whereby, said first and second support members can be separately manipulated.

3. A holder as defined in claim 2 wherein said first support member comprises an upper leg support member comprising:

a platform on which the thigh of the upper leg rests;

a first movable side wall mounted on said platform;

a second movable side wall mounted on said platform and being movable towards and away from said first movable side wall;

clamp means for clamping said movable side walls into position along said platform;

a first post having a vertical portion and a horizontal portion;

a block mounted on said horizontal portion for pivoting about said horizontal portion;

said platform being mounted on said block;

whereby, said platform is pivotable about said horizontal portion.

4. A holder as defined in claim 3 wherein each of said side walls includes a plurality of parallel horizontal slots;

a Velcro strap having a first end, insertable into one of the slots of said first stationary side wall, and a second end insertable into one of the slots of said second movable side wall;

whereby, said thigh is restrained between said side walls, said platform and said strap.

5. A holder as defined in claim 1 wherein said second support member comprises a lower leg support member, comprising:

a block having an opening;

the free end of said transdraping spear extending into and being held in said opening;

said block further having a circular opening;

a spaced opening extending downwardly from said circular opening to the bottom edge of said block;

said elongated arm having a ball at one end thereof, said ball being disposed in said circular opening to form said ball joint;

clamping means for clamping said spaced opening;

whereby, the attitude of said elongated arm can be manipulated around said ball joint, and said ball can be clamped into position to fix the attitude of said elongated arm.

6. A holder as defined in claim 5 and further including a first square post, said elongated arm being connectable to said first square post at one end thereof;

a foot holder mounted on the other end of said first square post.

7. A holder as defined in claim 6 wherein:

said transdraping spear is removable from said block;

said elongated arm is removable from said block;

said square post is disconnectable from said third post; and said foot holder is disconnectable from said square post;

whereby, to break down said second support member into small enough parts to be auto-clavable.

8. A holder as defined in any one of claims 4 or 7 and further including a table mount clamp;

said table mount clamp having a first clamp at one end thereof for clamping said table mount clamp to said operating table;

said table mount clamp having a first opening in a top surface thereof for receiving said first post therein, said first post being movable into and out of said opening whereby to adjust the vertical distance between said platform and said operating table, said first post being rotatable within said opening;

said first clamping means clamping said first post in position in said first opening;

said table mount clamp further including a second opening in an end surface thereof, said second opening receiving said transdraping spear; and said second clamping means clamping said transdraping spear in position in said second opening.

9. A holder as defined in any one of claims 4 or 7 wherein said operating table:

has a first opening in a top surface thereof adjacent the front end and one side of said operating table, said first opening receiving said first post such that said first post is movable into and out of said first opening whereby to adjust the vertical distance between said platform and said operating table, said first post being rotatable in said first opening, said first clamping means clamping said first post into position into said first opening; and a second opening in the front edge of said operating table, said second opening receiving said transdraping spear, said second clamping means clamping said transdraping spear in position in said second opening.

10. A free arm universal leg holder for supporting a leg of a patient lying on an operating table under surgical draping during surgical procedures on the supported leg;

said leg holder comprising:

clamp means mounted on an edge of said operating table;

said clamp means supporting pivoting means pivotable about the horizontal axis of said table;

a casing attachment removably mounted on said pivoting means for pivoting therewith;

telescoping arm means extending from said casing attachment for supporting said supported leg;

whereby said telescoping arm is pivotable about said horizontal axis;

said surgical draping being disposed between said pivoting means and said casing attachment to cover said pivoting means and said clamp means whereby said clamp means and said pivoting means are out of the sterile field and only said casing attachment and said telescoping arm are in said sterile field.

11. A holder as defined in claim 10 wherein said pivoting means comprises a friction ratchet clutch;

said ratchet clutch comprising attaching means for removably attaching said casing attachment to said ratchet clutch.

12. A holder as defined in claim 11 wherein said ratchet clutch is housed in a cylindrical housing and having two pins extending out of each end of said housing;

said casing attachment comprising a box-like member and having slots in one side wall thereof, said slot engaging said pins whereby said box-like member is removably mounted on said cylindrical housing.

13. A holder as defined in claim 12 wherein said telescoping arm comprises a first element, a second element and a third element, said first element being telescopable into said second element which is telescopable into said third element;

friction lock means for locking said elements into position relative to each other.

14. A holder as defined in claim 13 and including a concave shaped buttress at the free end of said telescoping arm;

whereby a surgeon can manipulate the position of said telescoping arm using his hip, waist or leg.

15. A holder as defined in claim 14 wherein said clamp means comprises a platform extending from a side thereof;

said cylindrical body being mounted on said platform to be pivotable about a vertical axis;

whereby said telescoped arm is pivotable about said vertical axis.

16. A holder as defined in claim 15 wherein said telescoping arm mounts a foot holder adjacent the free end thereof;

said foot holder being pivotable about a vertical and horizontal axis;

said foot holder being disposed in said sterile field.

17. A holder as defined in claim 16 wherein said clamping member includes an opening in the top surface thereof;

said opening clampingly receiving an upper leg support member;

whereby, the distance above the operating table at which the upper leg is supported is adjustable.

18. A holder as defined in claim 16 wherein said casing attachment has an opening in the top surface thereof at the free end thereof;

said opening receiving a stress plate for supporting the upper leg of said patient;

wherein said stress plate is in said sterile field.

* * * * *